United States Patent [19]

Juzi

[11] 4,290,390

[45] Sep. 22, 1981

[54] STEAM GENERATOR

[75] Inventor: Heinz Juzi, Andelfingen, Switzerland

[73] Assignee: Sulzer Brothers Limited, Winterthur, Switzerland

[21] Appl. No.: 104,428

[22] Filed: Dec. 17, 1979

[30] Foreign Application Priority Data

Dec. 22, 1978 [CH] Switzerland ..... 13096/78

[51] Int. Cl.[3] ..... F22B 37/62

[52] U.S. Cl. ..... 122/406 S; 122/451 S; 122/122; 122/479 S

[58] Field of Search ..... 122/406 R, 406 S, 406 ST, 122/451 S, 479 S; 60/646, 667

[56] References Cited

U.S. PATENT DOCUMENTS

| | | | |
|---|---|---|---|
| 3,212,477 | 10/1965 | Gerber et al. | 122/406 ST |
| 3,313,111 | 4/1967 | Strohmeyer | 122/406 ST |
| 3,690,303 | 9/1972 | Dolezal | 122/406 S |
| 4,205,633 | 6/1980 | Wittchon | 122/406 S |

*Primary Examiner*—Edward G. Favors
*Attorney, Agent, or Firm*—Kenyon & Kenyon

[57] ABSTRACT

A water outlet pipe leading to a feed water tank is connected to a separator disposed downstream of an evaporator. A heat exchanger and a first control valve are disposed in the water outlet pipe, the valve being influenced by the level in the separator 20. In the heat exchanger heat is transmitted from the water flowing out of the separator to the feed water flowing to the heating surfaces of the vapor or steam generator. Between the heat exchanger and the first control valve, a bypass pipe branches from the water outlet pipe and contains a second control valve which is also influenced by the level in the separator. The bypass pipe leads into a condenser. A considerable proportion of the water leaving the separator is discharged via the bypass pipe to the condenser as a result of the pipe branching off upstream of the first control valve. Consequently, the flow cross-section of the first control valve and the cross-section of a safety blow-off means provided on the feed-water tank can be considerably reduced in size.

12 Claims, 2 Drawing Figures

STEAM GENERATOR

Figure 1:
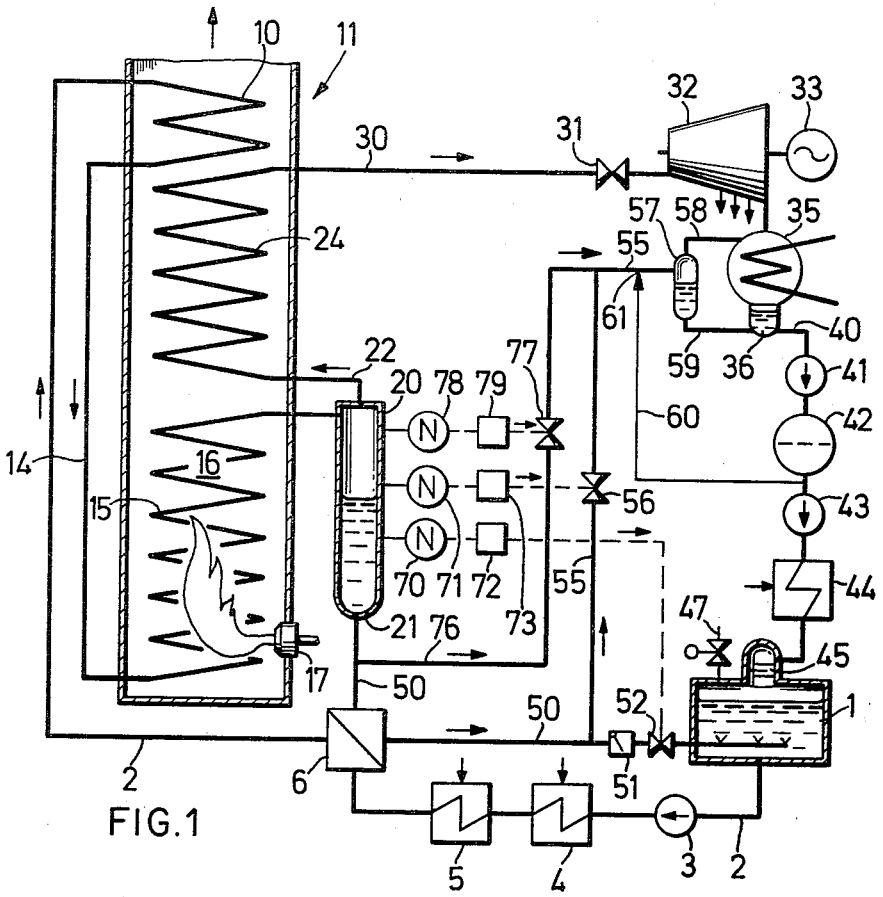

This invention relates to a steam generator. More particularly, this invention relates to a steam generator having a water separator connected downstream of an evaporator.

As is known, various types of steam or vapor generators have been used for producing steam. In many cases, the steam generators have utilized an evaporator for initially vaporizing a feed water flow as well as a water separator downstream of the evaporator in order to separate water from the produced vapor and to provide for a return of the separated water to a feed water tank. For example, as described in German Pat. No. 802,458, it has been known to discharge all of the separated water from the separator through a water outlet pipe in which a single control valve is disposed in a manner to maintain the level of water in the separator constant. It is also known to connect a bypass pipe containing a valve to the water outlet pipe downstream of the control valve so that water can be discharged from the separator through the bypass pipe when necessary. However, such a steam generator requires the total cross-section of the valves to be very large. Further, because of the pressure drop occurring in the control valve in the water outlet pipe, the valve in the bypass pipe may contain some steam or vapor. This, in turn, results in the possibility of a cavitation erosion occurring.

Accordingly, it is an object of the invention to reduce the overall cross-section of a valve used to control the water level in a water separator of a steam generator.

It is another object of the invention to reduce the risk of cavitation in a valve controlling the water level in a water separator of a steam generator.

Briefly, the invention is directed to a steam generator having a feed water tank, a heat exchanger having a secondary side to recieve a flow of water from the tank and a primary side, an evaporator downstream of the heat exchanger for receiving and evaporating a flow of water and a water separator downstream of the evaporator for separating water from a flow of vapor from the evaporator. In addition, a water outlet pipe connects the water separator to the feed water tank via the primary side of the heat exchanger to deliver separated water thereto. In accordance with the invention, a control valve is disposed in the outlet pipe in order to control the flow of water to the feed tank in response to a predetermined level of water in the separator. Also, a bypass pipe branches from the outlet pipe upstream of the control valve and a second control valve is disposed in the bypass pipe to control the flow of water therethrough in response to a second level of water in the separator which is higher than the above noted predetermined level. Such a construction permits the total cross-section of the two valves to be made smaller than otherwise. In addition, there is little danger of steam or vapor appearing in the control valve in the bypass pipe.

In addition, because of the reduction in size of the control valve in the outlet pipe to the feed water tank, the total cross-section of a blow-off device which may be provided on the feed water tank for safety reasons can be greatly reduced. Another advantage appears in the reduction in the size required of blow-off pipes leading from the blow-off devices to atmosphere.

When the generator is started up, a considerable proportion of the water in the separator can be discharged via the bypass pipe. Since the separated water usually contains impurities on starting up, this can be regarded as an advantage since a concentration of impurities in the water section of the steam generator is avoided.

In accordance with the invention, the steam generator also comprises a condenser downstream of the evaporator and upsteam of the feed water tank for receiving and condensing a flow of steam which is produced by the generator. In accordance with the invention, the bypass pipe connects to the condenser in order to deliver water thereto from the water separator. Thus, the water discharged through the bypass pipe not only is desalinated but also is not lost. To this end, the impurities in the water can be retained by a condensate purifier or cleaner disposed between the condenser and the feed water tank.

In accordance with the invention a suitable means is provided for controlling each valve in response to the level of water in the separator whereby the valve in the outlet pipe and then the valve in the bypass pipe are opened in sequence as the water level rises in the separator and are closed in inverse sequence as the water level falls in the separator. Once the size of the control valve in the outlet pipe is selected, this means enables the maximum quantity of heat energy discharged from the heat exchanger with the recycled water to be recovered.

The valve in the outlet pipe can be made of relatively small dimensions. However, the valve is capable at a fully open state of passing a maximum of 125% of the water accumulating in the separator at minimum load of the steam generator while passing less than the maximum of the water accumulating in the separator upon starting of the generator. This permits the generator to operate most effectively.

In another embodiment, a second bypass pipe may branch from the outlet pipe and be connected directly to the condenser to deliver water thereto. In this case, a further control valve is disposed in the second bypass pipe to control the flow of water therethrough in response to a third level of water in the separator which is higher than the above noted levels. In this case, a means is provided for controlling the three valves so that the valves are opened in sequence as the water level rises in the separator and are closed in inverse sequence as the water level falls. This allows the size of the heat exchanger to be optimized with respect to the overall cost of the generator.

A vapor and water separator can be interconnected between the bypass pipe and the condenser in order to protect the condenser. In this case, the separator is preferrably provided with an injection cooler as is known per se.

In one embodiment, in order to regulate the control valves, a level pick-up means can be provided on the water separator for sensing the level of water therein and generating a proportional signal in response thereto. In this case, a pair of proportional elements are connected to the pick-up means to receive the signal and to control the valves via a suitable connection in response to the signal. In this case, each proportional element has a different adjustment relative to the other element. If three control valves are provided, due to the use of two bypass pipes, three proportional elements are connected to the level pick-up means in similar fashion. This construction enables a single pick-up means to be used on the water separator.

A safety blow-off means can be provided on the feed water tank for expelling steam from the tank at a predetermined pressure in the tank. This enables use of the generator under conditions in which the water separator is operated in the dry state during normal operation.

If the separator is run dry at full load, in order to effect additional economies in the safety blow-off means, a pick-up means can be provided in the outlet pipe upstream of the control valve therein for separating steam from the flow of water passing therethrough. This pick-up means is connected to the control valve to close the valve in response to a predetermined state of aggregation in the pick-up means. As is known, a steam trap may be used as the pick-up means since such is a well known separating means which allows water to escape but does not permit steam or vapor to escape. Such traps have proved satisfactory in practice and are reliable and inexpensive means of preventing steam or vapor from entering the feed water tank.

Figure 2:
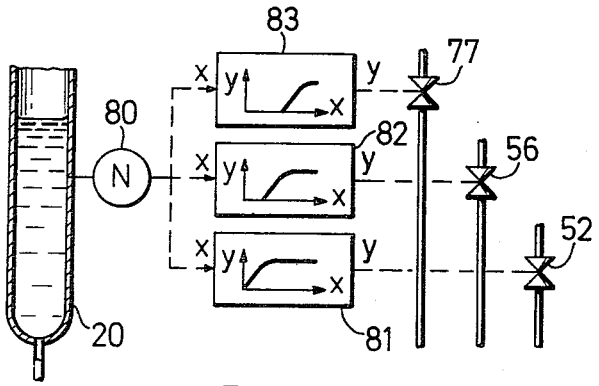

These and other objects and advantages of the invention will become more apparent from the following detailed description and appended claims taken in conjunction with the accompanying drawings in which:

FIG. 1 illustrates a diagrammatic view of a steam generator according to the invention; and FIG. 2 illustrates an alternative means for actuating the control valves in accordance with the invention.

Referring to FIG. 1, the steam generator is provided with a feed water tank 1 from which water can be drawn via a feed pipe 2 containing a feed pump 3 and two high pressure preheaters 4, 5 through a secondary side of a heat exchanger 6. As shown, the feed pipe 2 connects to an economizer 10 within a jacket 11 of the steam generator. The economizer 10 has an outlet which is connected to an input of an evaporator 15 via a pipe 14. This evaporator 15 forms the wall tubing of a combustion chamber 16. In addition, a suitable burner 1 extends into the combustion chamber 16 in known manner.

A suitable line leads from an outlet of the evaporator 15 to a water separator 20 which has an outlet 21 for separated water at the bottom and a vapor discharge pipe 22 at the top which leads to a superheater 24 disposed within the jacket 11 of the steam generator in the space above the combustion chamber 16. A live steam pipe 30 leads from an outlet of the superheater 24 via a live steam valve 31 to a turbine 32 which is mounted on a common shaft with a generator 33. Also, a condenser 35 with a hot well 36 is connected to a low pressure end of the turbine 32 while a condensate pipe 40 extends from the hot well 36 via a first condensate pump 41, a condensate cleaner 42, a second condensate pump 43 and a low pressure preheater 44 to a deaerator tower 45 mounted on the feed water tank 1.

As shown, a safety blow-off means, for example a safety valve 47 is mounted on the feed water tank 1 adjacent to the tower 45 and serves to expell steam from the tank 1 at a predetermined pressure in the tank 1. A pressure pick-up (not shown) may also be provided on the feed water tank 1 to act on valves disposed in bleeder steam pipes of the high pressure preheaters 4, 5 in order to control the vapor pressure in the tank 1 by influencing the temperature of the feed water at the entry to the heat exchanger 6. In addition, a water outlet pipe 50 connects the outlet 21 of the water separator 20 to the feed water tank 1 via a primary side of the heat exchanger 6 in order to deliver separated water thereto.

As shown, the outlet pipe 50 has a non-return valve 51 therein and a control valve 52. Also, a bypass pipe 55 branches from the outlet pipe 50 upstream of the control valve 52 and non-return valve 51, i.e. between the non-return valve 51 and heat exchanger 6. This bypass pipe 55 contains a control valve 56 and leads to a water and vapor separator 57. The separator 57 has a vapor outlet 58 which is connected to the vapor space of the condenser 35 as well as a water outlet 59 which is connected to the hot well 36 of the condenser 35. In addition, an water injection pipe 60 branches from the condensate pipe 40 between the condensate cleaner 42 and the condensate pump 43 and leads into the bypass pipe 55 at an injection point 61 directly upstream of the separator 57. A means is also provided for controlling each valve 52, 56 in response to the level of water in the separator 20. For example, this means includes two level pick-up means 70, 71 which are disposed one above the other on the separator 20 in order to sense the level of water therein and to generate a signal in response thereto. Each pick-up 70, 71 has an output which is connected to a respective controller 72, 73. The output of one controller 72 connects to the control valve 52 to regulate the valve 52 while the output of the second controller 73 acts on the valve 56 in the bypass pipe 55. The controllers 72, 73 are constructed so that when the water level rises, the valve 52 in the outlet pipe 50 opens first followed by the valve 56 in the bypass pipe 55. The valves 52, 56 are also operated in an inverse sequence so as to close as the water level falls in the separator 20. The opening and closing movements of the two valves 52, 56 may be consecutive or may overlap or there may be a clearance between the two movements.

Referring to FIG. 1, a second bypass pipe 76 may also branch from the outlet pipe 50 and be connected to the condenser 35 via the separator 57 either directly or through the bypass pipe 55. As shown, the bypass pipe 76 branches from the pipe 50 between the outlet 21 of the separator 20 and the heat exchanger 6. This bypass pipe 76 contains a control valve 77 between the branch point and the injection point 61. This control valve 77 is actuated by a level pick-up means 78 via a controller 79 in similar manner as above. In this case, the control means for the valves 52, 56, 77 operates such that the valves open in sequence as the water level rises in the separator 20 and close in inverse sequence when the water level falls. That is, the valve 77 is the last to open when the water level rises and is the first to close when the water level falls.

In the following description of the operation of the steam generator, it is assumed that the bypass pipe 76 containing the valve 77, the level pick-up means 78 and the controller 79 are not provided. Starting from a cold state then takes place as follows:

Water is first fed by the feed pump 3 to the separator 20 from the feed water tank 1 via pipe 2, economiser 10, pipe 14 and evaporator 15. The control valves 52, 56 open as the level in the separator rises. Depending on the pressure difference at the control valve 52, some of the water thus flows through the control valve 52 back into the feed water tank 1 while the rest flows to the condenser 35 via the control valve 56. The burner 17 is then ignited. Vapor thus forms in the evaporator 15 and results in a considerable amount of water being ejected into the separator 20. Under these circumstances, the valve 56 is fully opened and the storage capacity of the separator 20 is also taken up. As the starting operation continues, the pressure in the generator rises so that the speed of flow through the control valves 52, 56 increases. Given a constant delivery of the feed pump 3, the control valve 56 starts to close because of the falling level in the separator. The feed water is increasingly heated up in the heat exchanger 6 as a result of the increasing enthalpy of the water returned via the outlet pipe 50. An increasing proportion of the heat contained in the returned water is thus recovered in the heat exchanger 6 and another considerable proportion is fed to the feed water tank 1, while a proportion of the heat which decreases with increasing load, i.e. with increasing boiler pressure, is discharged to the condenser 35.

When the generator has reached a minimum load, e.g. 15%, and the corresponding generator pressure, the control valve 52 can discharge all the water separated in the separator 20. The level in the separator 20 drops to such an extent that the valve 56 closes. Consequently, all the heat contained in the returned water is recovered. As the generator output increases further, the water content of the steam at the evaporator outlet falls. The level in the separator 20 falls further and the control valve 52 is also closed successively in these conditions. Finally, slightly superheated steam flows to the separator 20, and evaporates the water still left therein.

As will be apparent from this description, the system described enables the evaporator 15 to be fed with a constant amount of feed water from zero up to a limit load, e.g. 30%, the surplus water being returned from the separator 20, while above this load the generator can be operated with the separator 20 dry. Of course, the circuit is also suitable for the known construction in which the evaporator 15 is operated with slight moisture above the limit load of, for example, 30%.

If the water discharge pipe 76 with the valve 77, the level pick-up means 78 and the controller 79 are provided, the system operates as described, but with the difference that whenever there is a high water level in the water separator 20 some of the water flows through the discharge pipe 76 and past the heat exchanger 6 directly to the condenser 35. The advantage of this is that the heat exchanger 6 can be of smaller construction. A disadvantage, however, is that more heat is lost in the condenser 35 during a specific short portion of the starting-up time. It is a question of plant management whether it is economic to provide the discharge pipe 76 and the valve 77.

During a relatively long period of operation with minimum load, the heat returned to the feed water tank 1 via the control valve 52 may result in an increase in the pressure in the feed water tank 1, so that the blow-off pressure of the blow-off means 47 is reached and the means 74 opens. To avoid such blowing-off, pressure pick-ups acting on the valves in the bleeder pipes to the high-pressure preheaters 4, 5 may be provided whereby first one and then the other or both of the valves can be operated in a throttling or closed position. The temperature of the feed water at the entry of the heat exchanger 6 thus drops so that the water returned to the feed water tank 1 via the control valve 52 is re-cooled to a value which precludes any response of the blow-off means 47.

Referring to FIG. 2, wherein like reference characters indicate like parts as above, a single level pick-up means 80 may be provided on the separator 20 to control the values 52, 56, 77. In this case, the pick-up means 80 senses the level of water in the water separator 20 and generates a proportional signal x in response thereto. This signal x is then transmitted to three proportional elements 81, 82, 83 which, in turn, control the valves 52, 56, 77 in response to the signal. As shown, the proportional elements 81, 82, 83 are disposed in parallel and each receives the same signal x. The elements 81, 82, 83 convert this input signal x into an output signal y in accordance with the graph shown in each. As indicated, if the value x rises for 0 onwards, valve 52 first opens substantially linearly and finally enters an asymptotic zone. At the start of this zone, the control valve 56 then starts to open substantially linearly. As soon as the valve 56 reaches an asymptotic zone, the valve 77 starts to open.

In addition to the above two manners of regulating the control valves 52, 56, 77, various other possibilities are feasible. More particularly, a PI controller having a weak I component can be provided in the circuit shown in FIG. 2 between the level pick-up means 80 and the branch point of the line carrying the level signal x. This controller reduces the range of fluctuation of the level in the separator 20. Advantageously, means are provided whereby the output signal of the PI element is prevented from running away in the event of the separator 20 running dry.

Instead of controlling the valves 52, 56 and 77 in parallel, the valves may be controlled in cascade, the position of the valve 52 acting as a controlled variable on the position of the valve 56, while the position of the valve 56 influences the valve 77.

The attempt to reduce the safety blow-off means 47 on the feed water tank 1 does give rise to the risk that if the control valve 52 opens as a result of a malfunction, the pressure in the feed water tank 1 will rapidly rise under fullload conditions and when the separator 20 is dry. Thus, the feed water tank might explode. To reduce this risk appropriately, the control valve 52—or a gate valve disposed in series therewith—can be influenced by a pick-up means disposed in the pipe 50 to respond to the physical condition of the water and this closes the control valve (or the gate valve if provided) when vapor or steam enters the pick-up means.

A static or dynamic steam trap may also be provided in series with the control valve 52 to allow water to pass, but not steam or vapor.

Finally, a negative safety valve may be provided in series with the control valve 52, to be controlled by the pressure in the feed water tank 1 to close as soon as the pressure in the tank 1 exceeds a given critical value. Finally, another advantageous solution is to provide a tearable membrane in addition to the safety blow-off means, the cross-section of the membrane together with that of the blow-off means being designed for the full steam or vapor flow occurring in the feed water tank 1 in the case of malfunction.

What is claimed is:

1. In a steam generator, the combination comprising a feed water tank;

a heat exchanger having a secondary side to receive a flow of water from said feed water tank and a primary side;

an evaporator downstream of said secondary side of said heat exchanger for receiving and evaporating a flow of water therein;

a water separator downstream of said evaporator for separating water from a flow of vapor from said evaporator;

a water outlet pipe connecting said water separator to said feed water tank via said primary side of said heat exchanger to deliver separated water thereto;

a first control valve in said pipe to control the flow of water to said feed tank in response to a predetermined level of water in said separator;

a bypass pipe branching from said outlet pipe upstream of said control valve; and a second control valve in said bypass pipe to control the flow of water therethrough in response to a second level of water in said separator higher than said predetermined level.

2. The combination as set forth in claim 1 which further comprises a condenser downstream of said evaporator and upstream of said feed water tank for receiving and condensing a flow of steam therein; and wherein said bypass pipe connects to said condenser to deliver water thereto from said water separator.

3. The combination as set forth in claim 1 which further comprises means for controlling each said valve in response to the level of water in said separator whereby said first valve and said second valve are opened in sequence as the water level rises in said separator and are closed in inverse sequence as the water level falls in said separator.

4. The combination as set forth in claim 1 wherein said first valve is of relatively small dimensions and is capable at a fully open state of passing a maximum of 125% of the water accumulating in said separator at minimum load of the steam generator and of passing less than the maximum of the water accumulating in said separator upon starting of the steam generator.

5. The combination as set forth in claim 2 which further comprises a second bypass pipe branching from said outlet pipe and connected directly to said condenser to deliver water thereto, and a third control valve in said second bypass pipe to control the flow of water therethrough in response to a third level of water in said separator higher than said second level.

6. The combination as set forth in claim 5 which further comprises means for controlling each said valve in response to the level of water in said separator whereby said first valve, said second valve and said third valve are opened in sequence as the water level rises in said separator and are closed in inverse sequence as the water level falls in said separator.

7. The combination as set forth in claim 2 which further comprises a vapor and water separator interconnected between said bypass pipe and said condenser.

8. The combination as set forth in claim 1 which further comprises a level pick-up means on said water separator for sensing the level of water therein and generating a proportional signal in response thereto and a pair of proportional elements connected to said pick-up means to receive said signal and to said valves to control said valves in response to said signal, each said element having a different adjustment relative to the other of said elements.

9. The combination as set forth in claim 1 which further comprises a safety blow-off means on said feed water tank for expelling steam from said tank at a predetermined pressure in said tank.

10. The combination as set forth in claim 1 which further comprises a pick-up means in said outlet pipe upstream of said first valve for separating steam from a flow of water passing therethrough, said pick-up means being connected to said first control valve to close said first valve in response to a predetermined physical condition of the water in said pick-up means.

11. The combination as set forth in claim 10 wherein said pick-up means is a steam trap.

12. The combination as set forth in claim 11 which further comprises a safety blow-off means on said feed water tank for expelling steam from said tank at a predetermined pressure in said tank.

* * * * *

UNITED STATES PATENT AND TRADEMARK OFFICE

CERTIFICATE OF CORRECTION

PATENT NO. : 4,290,390

DATED : September 22, 1981

INVENTOR(S) : Heinz Juzi

It is certified that error appears in the above—identified patent and that said Letters Patent is hereby corrected as shown below:

Column 3, line 38, after "burner" change "1" to -- 17 --.

Column 5, line 52, after "means" change "74" to -- 47 --.

Column 5, line 64, after "the" (first occurrence) change "valaes" to -- valves --.

Column 6, line 6, after "rises" change "for" to -- from --.

Signed and Sealed this

*Twenty-sixth* Day of *January 1982*

[SEAL]

*Attest:*

*Attesting Officer*

GERALD J. MOSSINGHOFF

*Commissioner of Patents and Trademarks*